United States Patent [19]

Westlund

[11] 4,148,171

[45] Apr. 10, 1979

[54] BANDING APPARATUS AND METHOD

[76] Inventor: Gerald D. Westlund, 6684 Central Ave. N., Fridley, Minn. 55432

[21] Appl. No.: 758,657

[22] Filed: Jan. 12, 1977

[51] Int. Cl.[2] ..... B67B 5/00

[52] U.S. Cl. ..... 53/585; 53/291; 53/296; 53/589

[58] Field of Search ..... 53/291, 295, 290, 296, 53/297, 298, 183, 49, 184 R, 184 S, 198 R, 128

[56] References Cited

U.S. PATENT DOCUMENTS

| | | | |
|---|---|---|---|
| 2,623,673 | 12/1952 | Holstein | 53/291 |
| 2,765,607 | 10/1956 | Aguilar et al. | 53/297 X |
| 2,843,986 | 7/1958 | Carter | 53/291 |
| 2,846,835 | 8/1958 | Aguilar et al. | 53/291 |
| 3,594,975 | 7/1971 | Abrecht | 53/291 X |
| 3,738,210 | 6/1973 | Fujio | 53/292 X |
| 3,974,628 | 8/1976 | Konstantin | 53/297 X |
| 4,012,972 | 3/1977 | Rice | 53/291 X |
| 4,016,704 | 4/1977 | Fujio | 53/198 R X |

*Primary Examiner*—Horace M. Culver
*Attorney, Agent, or Firm*—Schroeder, Siegfried, Ryan, Vidas & Steffey

[57] ABSTRACT

A straight line transport, positively controlled banding apparatus and method. According to the method of the present invention, transport of a band is in a straight line from a starting position adjacent a mandrel, onto the mandrel band receiving end, along the mandrel to the mandrel delivery end, and directly off of the mandrel onto an article to be banded, and is positively controlled throughout the entire transport step of the process. According to a preferred embodiment of the banding apparatus, the apparatus comprises a tube opener, drive rollers for feeding and creasing a tube of banding material, a mandrel having a receiving end tapered to a knife-like edge, fingers for transporting a band along the mandrel, and means operable in synchronism with the fingers for holding the mandrel. In operation, the tube opener is inserted into the end of a tube and the tube end fed through the drive rollers which results in a partially open tube creased at ninety degree intervals around the tube. The creased tube is fed onto the receiving end of the mandrel which fully re-opens the tube. The knife cuts the tube above the mandrel to provide a band which is partially on the mandrel. The mandrel is lowered and the fingers moved initially in towards the mandrel above the band and then downwardly along the mandrel to strip the band from the mandrel onto an article positioned below the mandrel.

6 Claims, 33 Drawing Figures

BANDING APPARATUS AND METHOD

BACKGROUND AND FIELD OF INVENTION

The invention relates in general to the process commonly characterized as banding of containers or other articles, in particular to the "transport" step of a dry (as opposed to wet) process and specifically to transporting a creased band by means of an internal mandrel, and to apparatus for performing such processes and steps.

Briefly, banding comprises steps of opening, transporting, cutting, positioning, and shrinking. In both wet and dry processes, the banding material is most commonly supplied as a roll of tubing. The edges of the flat, ribbon-like tubing form a pair of opposed creases. In a dry process, a length of tubing, referred to as a band, is customarily cut from the roll of material, opened or re-opened, and transported to and positioned on a container or article.

In a wet process, the material is kept wet at all times until shrunk and it is customary to cut a band only after the tubing has been transported from the material source and applied to the article. The invention of J. G. Aguilar and Harold B. Rice described, illustrated and claimed in U.S. Pat. No. 2,860,468 which issued Nov. 18, 1958, is an example of a wet process banding apparatus and method.

In a dry process, it is customary to first cut a band and then transport the band to the article. There are numerous dry process banding processes and apparatus which employ an internal mandrel for transporting and positioning a band, for example, the invention of S. T. Carter described and illustrated in U.S. Pat. No. 2,771,725, which issued Nov. 27, 1956, hereinafter Carter; the invention of E. R. Levy described and illustrated in U.S. No. 2,680,549, hereinafter Levy; and the invention of Rodley Cross and John Laessig described, illustrated, and claimed in U.S. Pat. No. 3,888,067 which issued June 10, 1975, hereinafter Cross-Laessig.

Levy employs an initial rotational transport movement and concludes with axial positioning movement as the band is placed onto an article. The Levy apparatus partially opens pre-cut bands and loosely positions an opened band onto a tapered mandrel at a zero degree start position on a wheel which rotates about a horizontal axis. The mandrel with the loosely applied band is indexed to an upward orientation (90 degrees) where the band is forced onto the mandrel to a position on the mandrel base of a diameter which fully opens and holds the band. No further operations are performed on the band as the wheel is indexed another ninety degrees to orient the band and mandrel at 180°, but when the wheel is indexed another ninety degrees, to a position 270° from the start position, the band is axially stripped from the mandrel with a washer which is around the mandrel and the inside diameter of which is about the size of the mandrel base. The wheel carries four mandrels spaced ninety degrees apart. As previously indicated, the wheel is indexed in ninety degree increments. During normal operation, for each indexing step a band is loosely applied on the mandrel at the zero degree start position, another band is forced onto a mandrel at the ninety degree position to fully open the band, and a third band is stripped from a mandrel and positioned on an article at the two hundred seventy degree position. Mandrel and hence band transport movement is rotational and incremental until the band is stripped from the mandrel.

Carter transport movement is principally lateral. The Carter apparatus opens a band as it is cut from a continuous roll of material, laterally vacuum transports the partially opend band (the axis of which is vertical) to an overhead positioning mandrel-like guide, lowers the guide into the band, and then mechanically strips the band from the guide, again with a close fitting washer-like stripper. See FIGS. 18 through 22 and FIGS. 9 through 14 in particular.

In both Levy and Carter, virtually all of the band transport movement is non-axial and thus circuitous, although the final positioning movement in both is axial. Both Levy and Carter require non-axial circuitous transport apparatus which, although integrated with, are in addition to, the band positioning apparatus. In both, a significant part of the transport step is in a direction other than in a straight line between the source and destination of the material.

Cross-laessig also employs a combination of axial and non-axial transport and positioning. A band is cut, pneumatically partially opened and transported to one of a rotating wheel of mandrels. The pneumatic transport ends and mechanical indexed rotational transport on a mandrel then commences and continues until the band carrying mandrel is indexed over an article. The band is pneumatically axially stripped from the mandrel and positioned on the article.

An object of the invention is to provide a banding process which can be performed efficiently and economically.

Another object of the invention is a banding process which can be repetitively performed at a high rate of speed.

An additional object of the invention is a banding process which is economical to perform with multiple stations.

A specific object of the invention is a banding apparatus which is sufficiently light and compact to make it practical to incorporate a plurality of such apparatus as a single rotating structure to provide a high speed banding station which accepts articles to be banded from a single source of supply at a high rate of speed and delivers banded articles to a single output means at the same high rate of speed, specifically at a rate which is the individual apparatus speed multiplied by the number of apparatus of the station.

Another specific object of the invention is a banding apparatus which requires only a single mandrel.

A further object of the invention is a banding process which is efficient as well as fast.

Yet another object of the invention is a banding process in which a band is positively controlled during each step from cut-off of the band through positioning of the band on the article to be banded.

A still further object of the invention is a process in which a band is transferred along a straight line path directly from its source to an article to be bended.

An object of the invention is a process and means by which a force applied to open a tube has a significant component perpendicular to the tube axis and an insignificant component parallel to the tube axis to minimize resistance to feeding of the tube.

Yet another additional object of the invention is a banding apparatus for carrying out a process according to one or a combination of the foregoing objects.

Another object of the invention is an apparatus which provides transport of a band by means of a mandrel continuously aligned co-axial with and between the article to be banded and a source of supply of said band.

A further object of the invention is a banding apparatus mandrel having one end of a geometry which readily opens a tube of banding material without significantly opposing the linear feeding of the material.

An additional object of the invention is a banding apparatus mandrel having a truncated diamond geometry end for opening a tube of banding material.

An object of the invention is an apparatus which adds at least one crease to a flat ribbon tubing to provide a tube end which is normally open to facilitate feeding of the tube end onto the mandrel.

A further object of the invention is an apparatus which creases a tube with the same means necessary for other functions of the banding process.

BRIEF DESCRIPTION OF INVENTION

Briefly, according to the method of the present invention, transport of a band is in a straight line from a starting position adjacent a mandrel, onto the mandrel band receiving end, along the mandrel to the mandrel delivery end, and directly off of the mandrel onto an article to be banded, and is positively controlled throughout the entire transport step of the process.

According to a preferred embodiment of apparatus of the present invention, a tube of banding material is opened and the plane of the tube rotated ninety degrees about the tube axis. The tube opener is a ninety degree rotated, double wedge. With the tube so rotated, the original tube edges are brought together and passed through drive rollers to add a new pair of creases to the tube midway between the creases of the original tube edges. Such a tube creased at ninety degree intervals is old and well known in the art and provides a tube cross-section which is naturally slightly open as it emerges from the drive rollers. So creased, the mandrel, which has a receiving end tapered to a knife-like edge, opens and accepts the tube without significant resistance to feeding of the tube. The mandrel is generally vertical and is co-axial with the tube and with an article to be banded. After an appropriate length of tube has been fed onto the mandrel, the tube is cut to provide a band a significant part of which is already on the mandrel. The mandrel is then lowered. Fingers are next moved in towards the mandrel and above the band. The fingers engage the upper end of the band, urge the band fully onto and along the full length of the mandrel, and finally strip the band from the mandrel directly onto an article to be banded as the fingers are moved downwardly along the mandrel. The mandrel and fingers are then moved upwardly and the fingers moved outwardly to a position for receipt of the next band by the mandrel to complete a banding cycle.

DETAILED DESCRIPTION OF INVENTION

Figure 1:
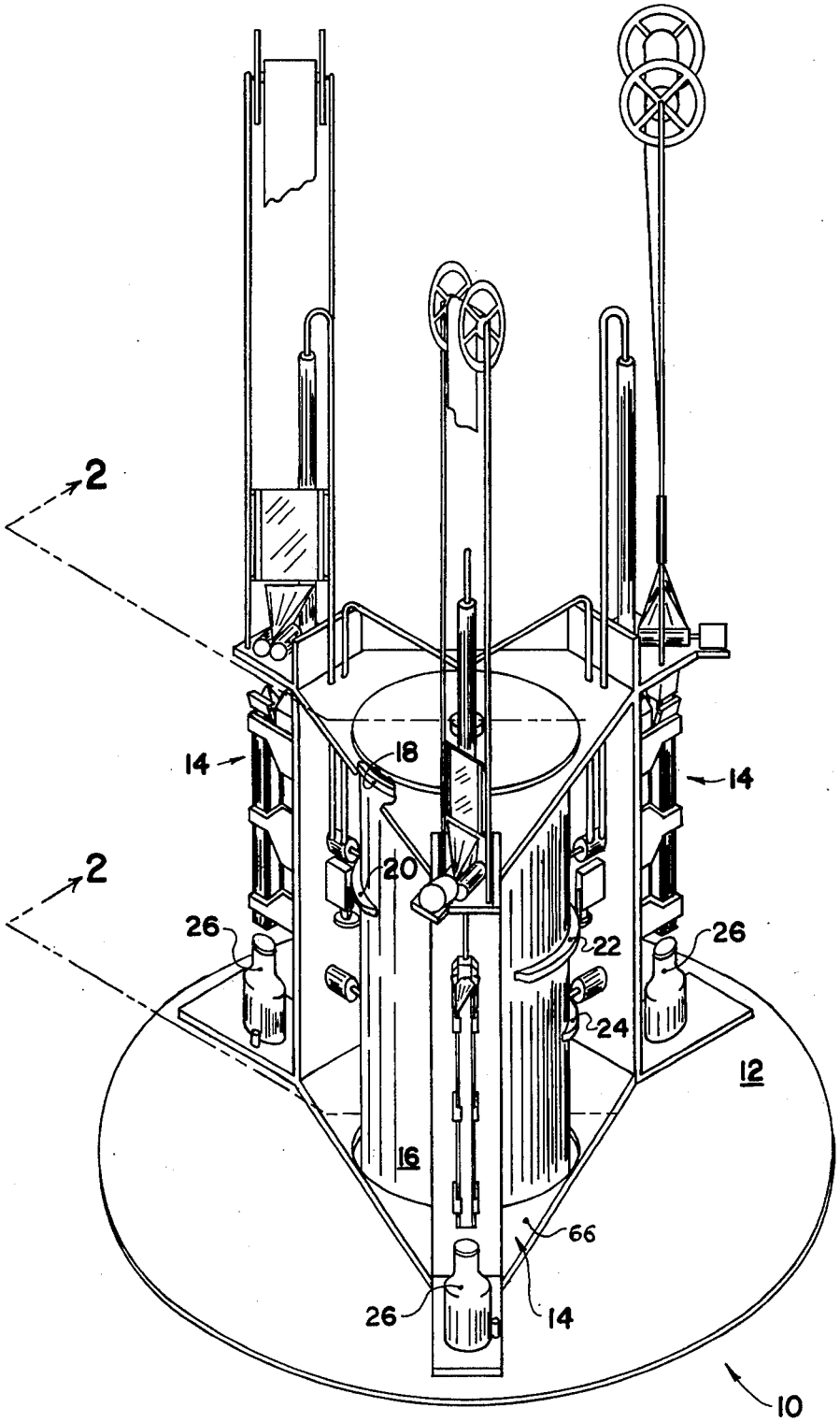
FIG. 1 is a perspective schematic illustration of three banding apparatus according to the present invention assembled as a single rotating banding station structure.

A banding station shown generally as 10 in FIG. 1 comprises a table 12, three identical banding apparatus, each shown generally as 14 and a timing mechanism 16 which is common to each apparatus. Timing mechanism 16 includes four timer actuators 18, 20, 22 and 24. Briefly, table 12 with apparatus 14 rotates about stationary timing mechanism 16. Articles to be banded are provided from a single source (not shown) at a high rate of speed. As each apparatus 14 passes the source, an article 26 is positioned on the apparatus. Apparatus for so positioning an article such as a star wheel is old and well known and does not form a part of this invention. Operation of the apparatus 14 tube feeding, cutting, and band transport functions is controlled by timer actuators 18, 20, 22 and 24 as the apparatus 14 rotates about timing mechanism 16. For each three hundred and sixty degree revolution of table 12, a banded article 26 is delivered to an output means (not shown and likewise well known and not a part of this invention) by each apparatus 14.

Figure 2:
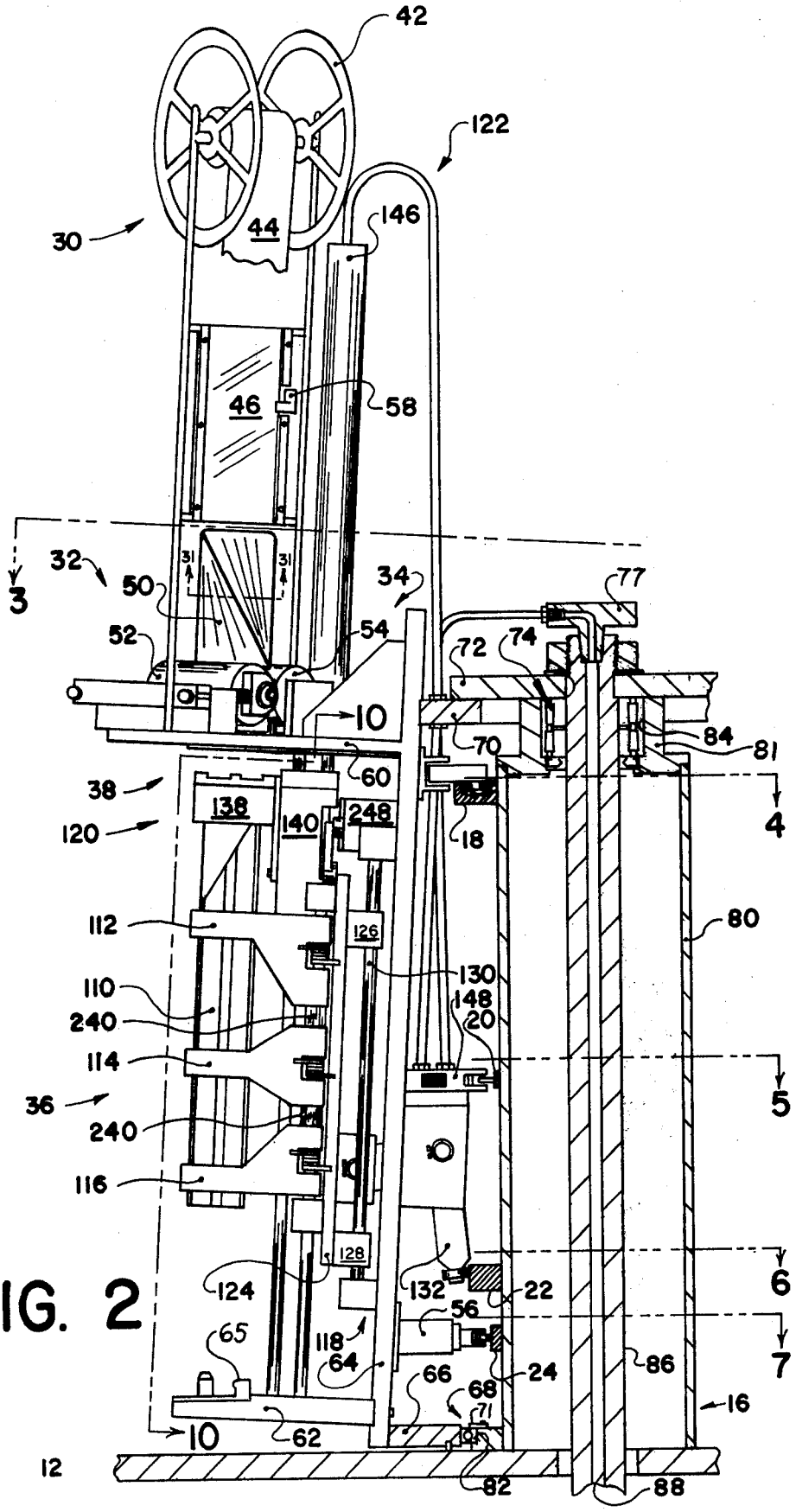
FIG. 2 is a detailed partially sectional side elevational view of one of the preferred embodiment banding apparatus taken along line 2 of FIG. 1.

FIG. 2 is a side elevational view of an apparatus 14 and a sectional view of the timing mechanism 16 and table 12 taken along lines 2—2 of FIG. 1. The principal components of apparatus 14 are a tube supply means shown generally as 30, tube feed means shown generally as 32, a main frame shown generally as 34, a band transport means shown generally as 36, and a tube cutting means shown generally as 38. Tube supply means 30 includes a reel 42, a tube supply 44 wound upon reel 42, and a tube guide 46. Tube drive means 32 includes a tube separator 50 and a pair of tube feed rollers 52 and 54 driven by a drive motor which is hidden from view in FIG. 2. As shown, the feed rollers are rotated ninety degrees relative to the tube guide 46. Such ninety degree rotation facilitates adding a new pair of creases midway between the original creases. A switch 56 operates the drive motor under control of tube position sensor 58 and the timing mechanism 16 tube feed timer actuator 24. Main frame 34 includes an upper platform 60, banding platform 62, and a back plate 64. Back plate 64 includes a lower support member 66 which in turn includes a bearing 68, and upper support members 70 and 72 the latter of which similarly includes a bearing 74. Timing mechanism 16 includes a cylindrical drum 80 rigidly attached to table 12 at its base and including a pair of circular raceways, a first exterior raceway 82 for the main frame 34 lower support bearing 68 and a second interior raceway 84 for main frame 34 upper support bearing 74. Main frame 34 is rotated about timing mechanism 16 drum 80 by means of a drive shaft 86 which includes a bore 88 therethrough. Band transport means 36 includes a mandrel 110; upper, mid and lower mandrel holding arms shown respectively as 112, 114, and 116; mandrel movement means shown generally as 118; a band stripper assembly shown generally as 120; and, a band stripper assembly movement means shown generally as 122. Mandrel movement means 118 includes a support plate 124 mounted by upper collar 126 and and lower collar 128 for travel up and down guide rods 130. Actually, there are two each of collars 126 and 128 and guide rod 130; one of each is hidden from view in FIG. 2. Mandrel movement means 118 also includes a toggle lever 132 operated by mandrel positioning timer actuator 22 to raise and lower plate 124 as will subsequently be shown in, and described in greater detail with reference to, FIG. 8. Still with reference to FIG. 2, band stripper assembly movement means 122 includes a stripper finger 138 and cam block 140. The band stripper assembly movement means 122 also comprises a hydraulic cylinder 146 in communication with a source of fluid (in the preferred embodiment, air) through the bore 88 of shaft 86, and a control switch 148 which is operated by the band stripper timer actuator 20 of timing mechanism 16. Cylinder 146 is a double action cylinder. Both the top and bottom of the cylinder are connected, by separate lines, only one of which is visible in FIG. 2, to bore 88 through switch 148. The piston within the cylinder is free floating and relies upon air pressure applied at one or the other of its ends to position the piston.

Figure 3:
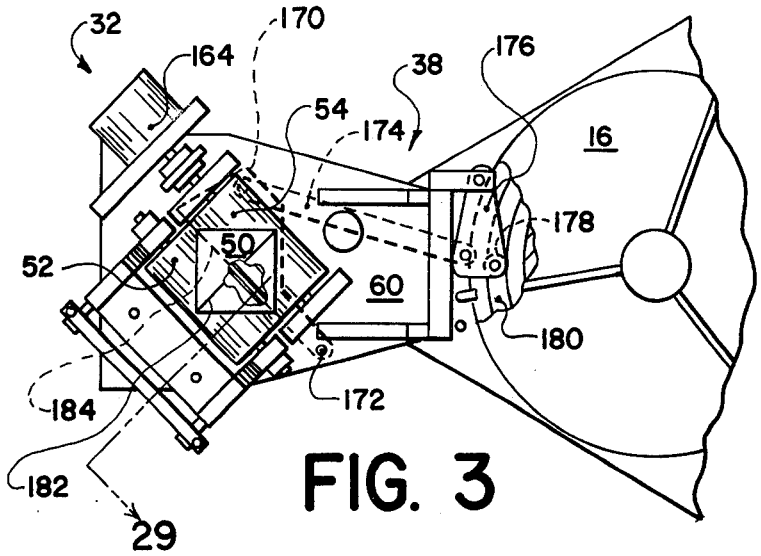
FIG. 3 is a sectional partially cut away view along line 3 of FIG. 2 illustrating the banding apparatus tube opening, tube feed, tube cutting and apparatus timing mechanism.

FIG. 3 is a top plan view illustrating the tube feed means 32, tube cutting means 38, timing mechanism 16 and tube opening means 50. Feed roller 54 is coupled to a drive motor 164. Tube cutting means 38 includes a shearing blade 170 pivotally connected by a pivot pin 172 to upper platform 60, are connected by a link 174 to a follower 176 which includes a wheel 178 which travels in a race 180 of timing mechanism 16 timer cutter actuator 18. Shearing blade 170 works against the edge of a stationary shear blade (not shown) attached to upper support platform 60. Tube opening means 50 is a double wedge having an upper edge 182 and lower edge 184. Each of edges 182 and 184 appear as a diagonal across a square. The pie shaped faces of the surfaces of tube opener 50 are more clearly shown in FIG. 2.

Figure 4:
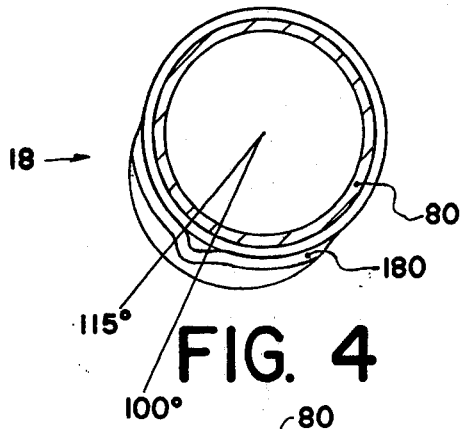
FIG. 4 is a sectional view along line 4 of FIG. 2 illustrating the timer cutter actuator of the timing mechanism.
Figure 5:
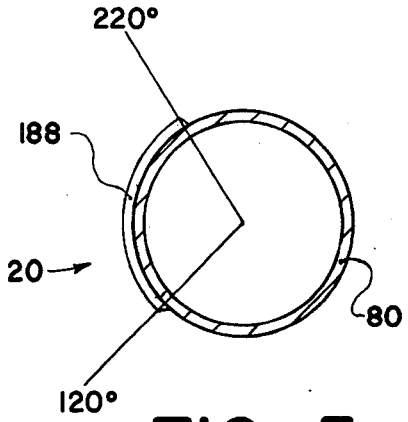
FIG. 5 is a sectional view along line 5 of FIG. 2 illustrating the timer band stripper actuator of the timing mechanism.
Figure 6:
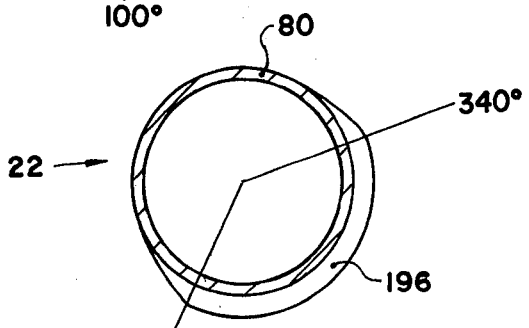
FIG. 6 is a sectional view along line 6 of FIG. 2 illustrating the timer mandrel positioning actuator of the timing mechanism.
Figure 7:
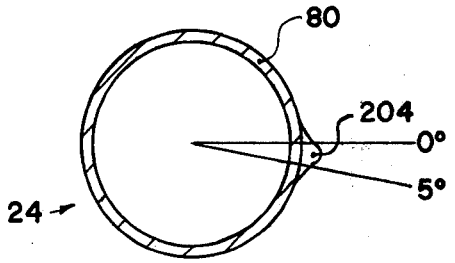
FIG. 7 is a sectional view along line 7 of FIG. 2 illustrating the timer tube feed actuator of the timing mechanism.

Timer cutter actuator 18 is shown in greater detail in FIG. 4, a sectional view taken along line 4 of FIG. 3 and comprises a channel 180 between 100 to 115 degrees around the circumference of drum 80. The timer band stripper actuator 20, timer mandrel positioning actuator 22, and timer tube feed actuator 24 are each similarly shown in detail in, respectively, FIGS. 5, 6, and 7, each a sectional view along lines 5, 6, and 7, respectively, of FIG. 3. Timer band stripper actuator 20 includes a band stripping portion 188 which extends between about 120 (one hundred twenty) to 220 (two hundred twenty) degrees. Timer mandrel positioning actuator 22 includes a raised position segment 196 between 340 to 115 (three hundred forty to one hundred fifteen) degrees, and a lowered position segment between 115 to 340 degrees. Timer tube feed actuator 24 includes a feed portion 204 between 0 to 5 (zero to five) degrees.

Figure 8:
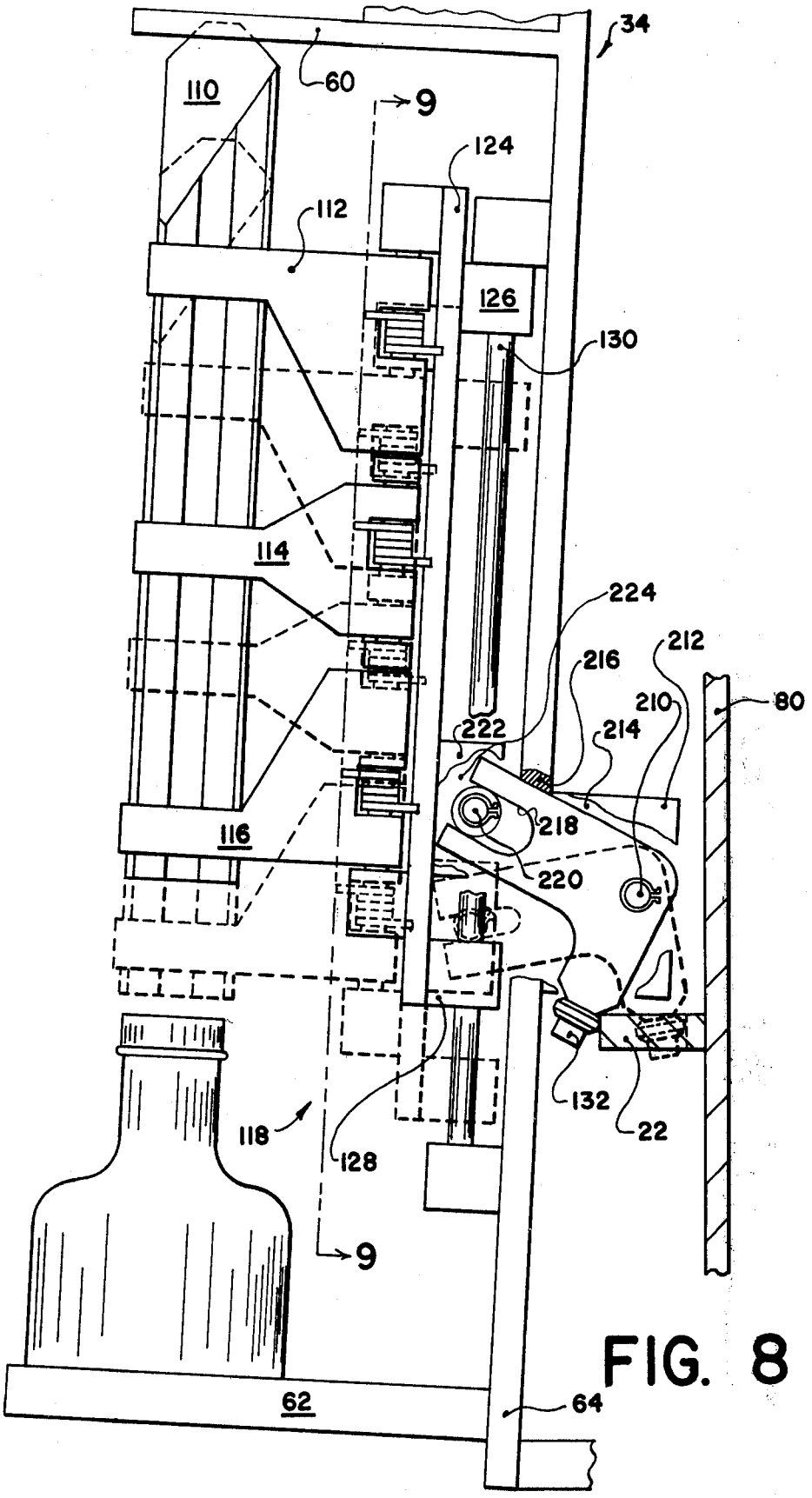
FIG. 8 is a side elevational view of the portion of the banding apparatus of FIG. 2 which holds and vertically moves the banding apparatus mandrel.

FIG. 8 is a side elevational fragmentary view of the main frame 34, mandrel 110, mandrel holding arms 112, 114, 116, and mandrel movement means 118, wherein the raised position of mandrel 110 is shown in solid lines and the lowered position in dashed lines. Lever 132 is pivotally mounted by a pin 210 between mounting plates 212 and 214. Plate 212 is partially cut away to provide an unobstructed view of lever 132. Both of plates 212 and 214 are attached to back plate 64. Lever 132 passes through a slot 216 in back plate 64 and includes a notch 218 which slidably engages a pin 220 mounted between supports 222 and 224. Supports 222 and 224 are each rigidly attached to plate 124, the former of which supports is partially cut away.

Figure 9:
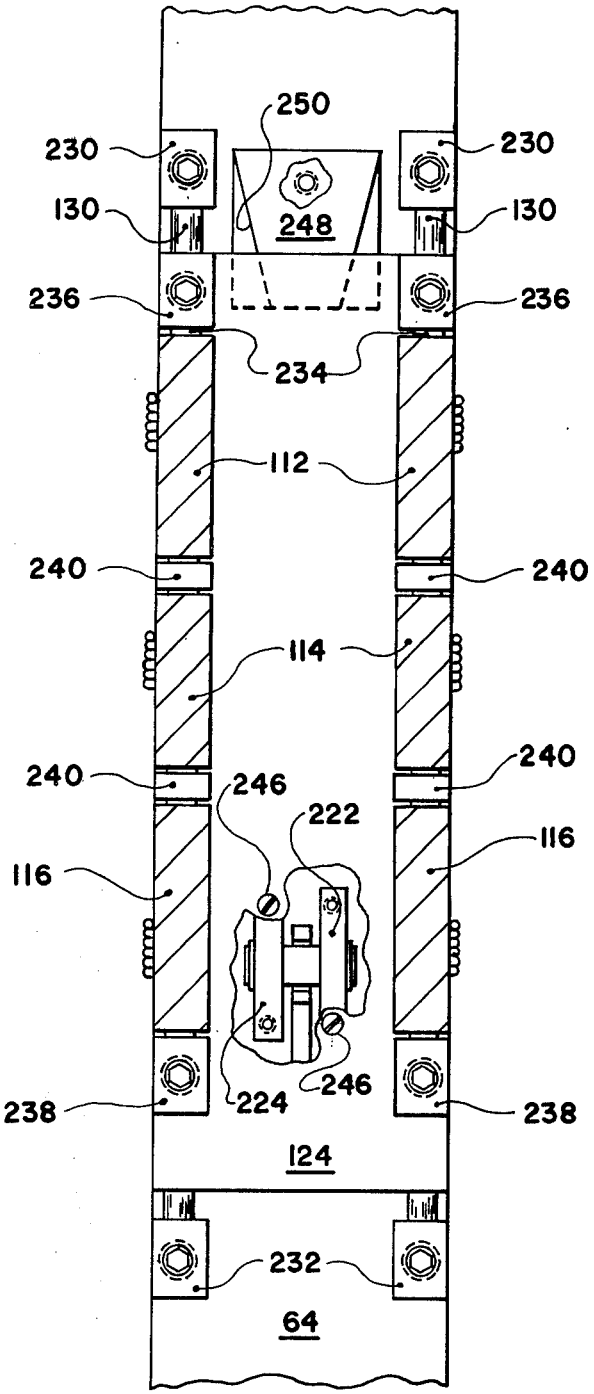
FIG. 9 is a sectional view taken along line 9—9 of FIG. 8 illustrating the mandrel holding means structure and its interconnection to the banding apparatus main frame plate and the attachment of the stationary cam and the mandrel lever to the main frame plate.

FIG. 9 is a sectional view taken along line 9—9 of FIG. 8. Guide rods 130 are each secured to back plate 64 by an upper mounting block 230 and a lower mounting block 232. Holding arms 112, 114 and 116 are mounted on a pivot rod 234 which is secured to plate 124 by a top pivot rod support 236 and bottom povit rod support 238. Holding arms 112 and 114 are vertically positioned on pivot rod 234 by vertical locating collars 240. Support plates 222 and 224 are secured to plate 124 by means of bolts 246. Although not shown in FIG. 9, mounting plates 212 and 214 are similarly bolted to back plate 64. A stationary cam 248 which includes a tapered surface 250 is also bolted to back plate 64.

Figure 10:
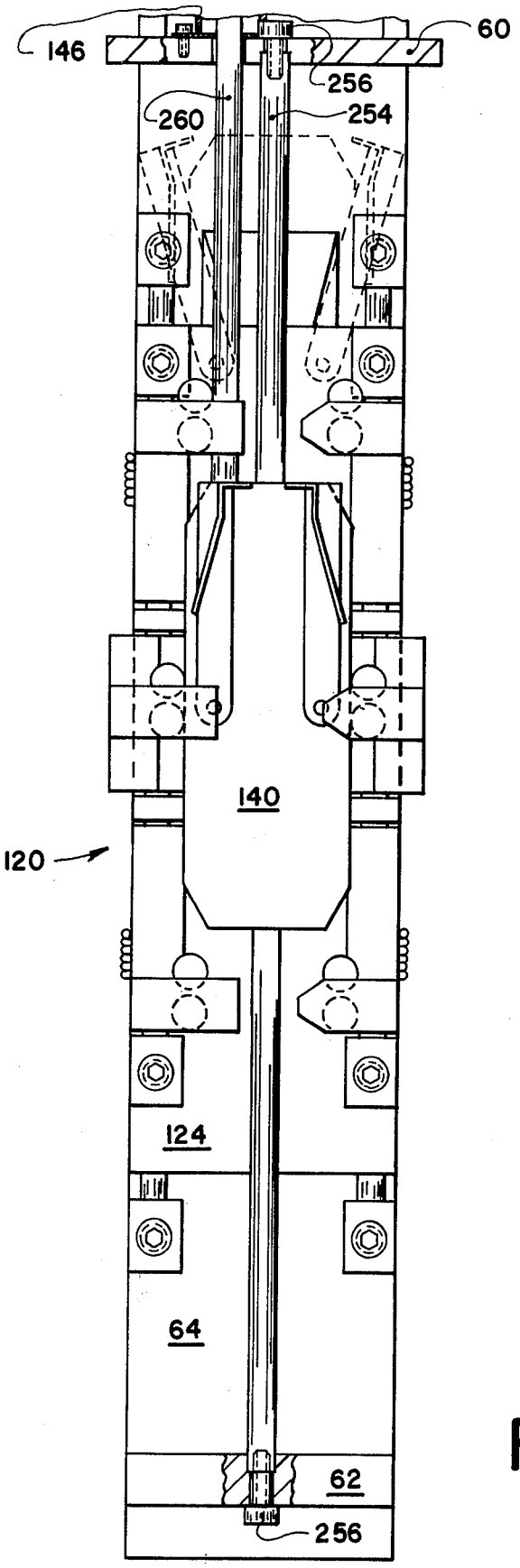
FIG. 10 is a front elevational view of the banding apparatus of FIG. 2 with the mandrel removed and the upper portion cut away.

FIG. 10 is a front fragmentary view of a banding apparatus 14 with mandrel 110 removed. Band stripper assembly 120 is mounted on a pair of shuttle rods 254 only the front one of which is visible in FIG. 10. Shuttle rods 254 are tapped on both ends and secured to banding platform 62 and upper support 60 with a cap screw 256. Band stripper assembly 120 is connected to the output shaft 260 of the piston of hydraulic cylinder 146. Details of the construction of the band stripper assembly 120 are shown in FIGS. 11 through 20.

Figure 13:
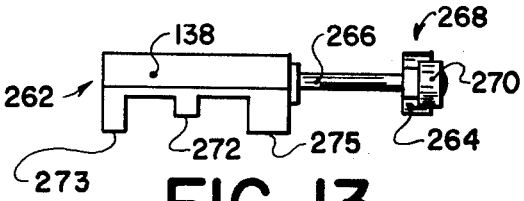
FIG. 13 is a top view of the finger assembly of FIG. 11.
Figure 11:
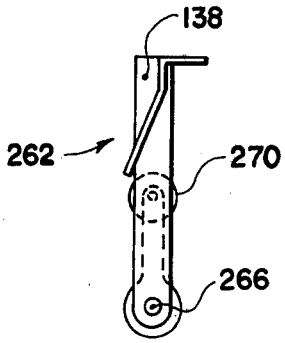
FIG. 11 is a front elevational view of a finger assembly of the band stripper assembly of FIG. 10.
Figure 12:
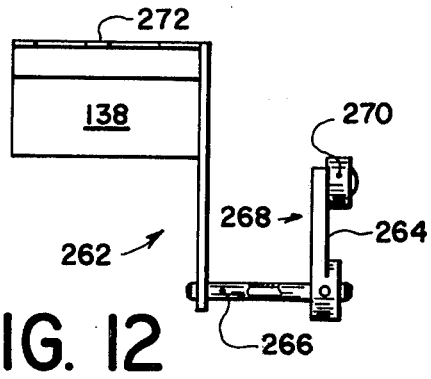
FIG. 12 is a side elevational view of the band stripper finger assembly of FIG. 11.
Figure 15:
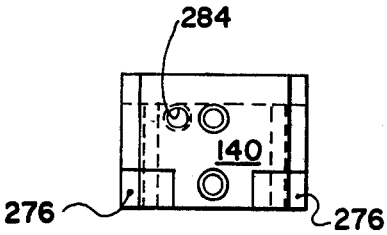
FIG. 15 is a top plan view of the cam block of FIG. 14.
Figure 14:
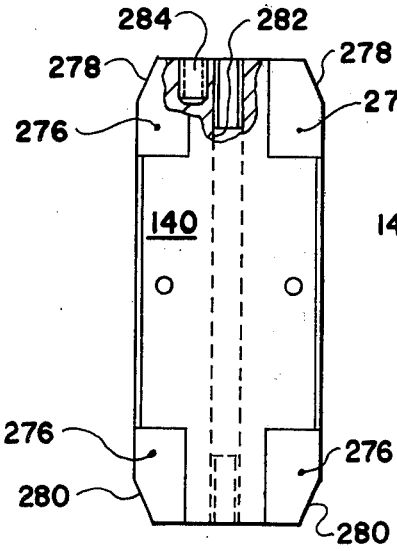
FIG. 14 is a partially cut away front elevational view of the cam block of FIG. 10.
Figure 16:
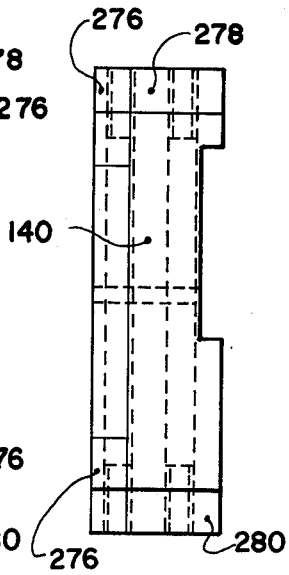
FIG. 16 is a side elevational view of the cam block of FIG. 14.
Figure 17:
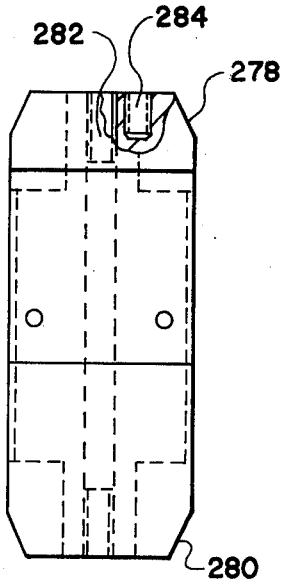
FIG. 17 is a rear elevational, partially cut away, view of the cam block of FIG. 14.

FIGS. 11, 12, and 13 are front, side and top views of band stripper assembly 120 finger assembly 262. The finger assembly is a fork-like member having three tines; the center tine is tooth 272. The outside tines 273 and 275 are spaced apart the width of mandrel 110. Finger assembly 262 includes a stripper finger 138 rigidly secured by a shaft 266 to a wheel assembly shown generally as 268. Wheel assembly 268 is rigidly secured to shaft 266 and includes a wheel 270 for low friction travel along a tapered surface 250 of the aforementioned stationary cam 248.

FIGS. 14, 15, 16, and 17 are front elevational, top and side and rear elevational views of a cam block 140. A cam block shoe 276 is inserted into each corner of the front of cam block 140, and cam block 140 includes a pair of shuttle rod passageways 282, and a tapped bore 284. A linear bearing is included in each end of each passageway 282. Tapped bore 284 provides for attachment of cam block 140 to output shaft 260.

Figure 18:
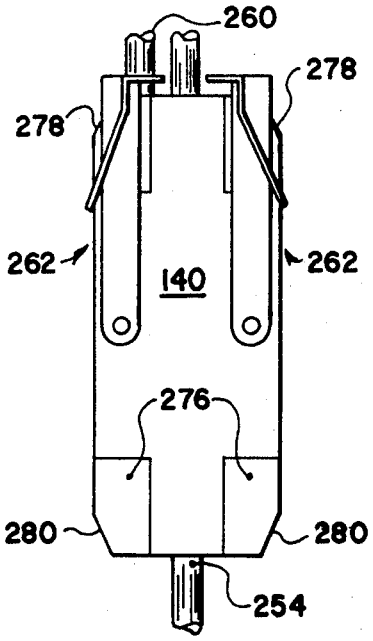
FIG. 18 is a front elevational view of a band stripper assembly comprising a pair of band stripper finger assemblies of FIG. 11 and a cam block of FIG. 14, and illustrating the means for interconnecting and mounting the assembly with and in the main structure of a banding apparatus 14.
Figure 19:
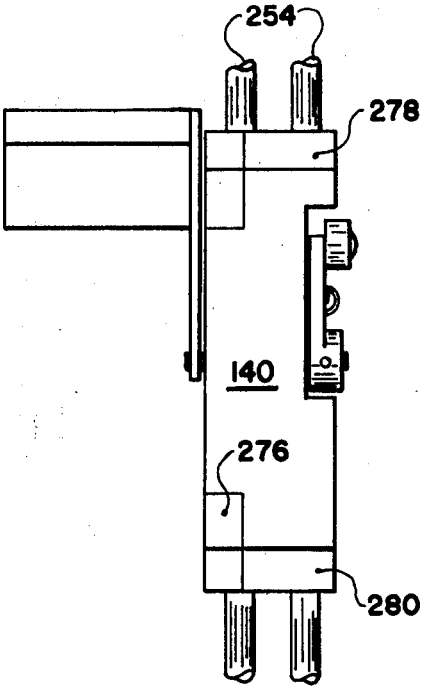
FIG. 19 is a side elevational view of the band stripper assembly of FIG. 18.
Figure 20:
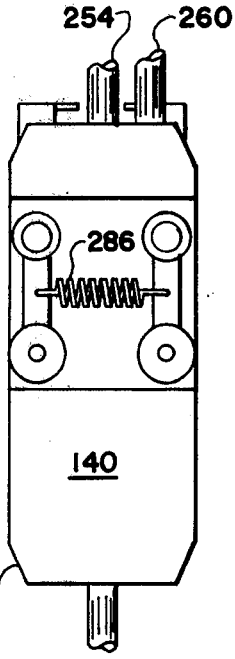
FIG. 20 is a rear elevational view of the band stripper assembly of FIG. 19.

FIGS. 18, 19 and 20 are, respectively, front, side, and rear elevational views of a band stripper assembly 120, including shuttle rods 254 and output shaft 260. A spring 286 tends to bias fingers 262 to the closed position illustrated.

Figure 21:
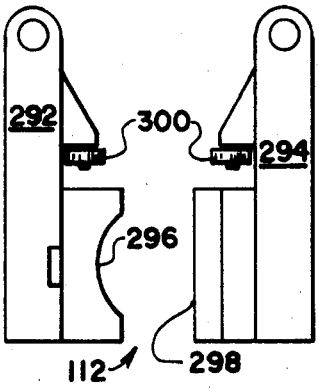
FIG. 21 is a top plan view of a pair of mandrel holding arms.
Figure 22:
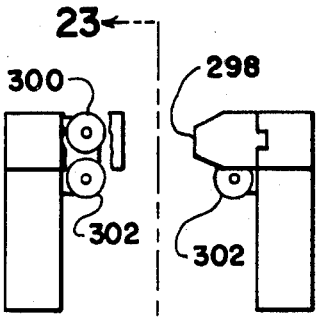
FIG. 22 is a partially cut away front elevational view of the mandrel holding arms of FIG. 21.
Figure 23:
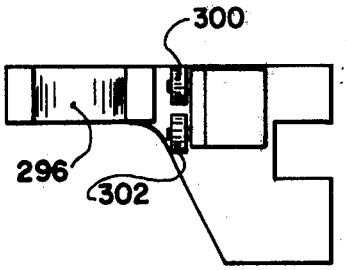
FIG. 23 is a side elevational view of the left hand mandrel holding arm of FIG. 21.
Figure 26:
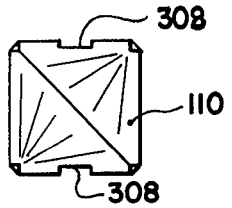
FIG. 26 is a top plan view of the mandrel of FIG. 25.

FIGS. 21, 22 and 23 illustrate holding arms for supporting a mandrel 110, not shown. FIGS. 21 and 22 are top and front views of a pair of top holding arms 112. Holding arms 112 comprise a right hand arm 292 and left hand arm 294. Arms 292 and 294 are virtually identical except for a horizontally radiused vertically straight bite 296 in arm 292 as contrasted with a straight, vertical gear tooth type bite 298 in arm 294. Each holding arm 292 and 294 includes a downward shuttle cam wheel 300 and an upward shuttle cam wheel 302. Middle holding arms 114 and lower holding arms 116 are very similar in construction to holding arms 112. They likewise include a radiused bite and a gear tooth bite in their left and right hand arms, respectively, and each includes upward and downward shuttle cam wheels 300 and 302.

Figure 24:
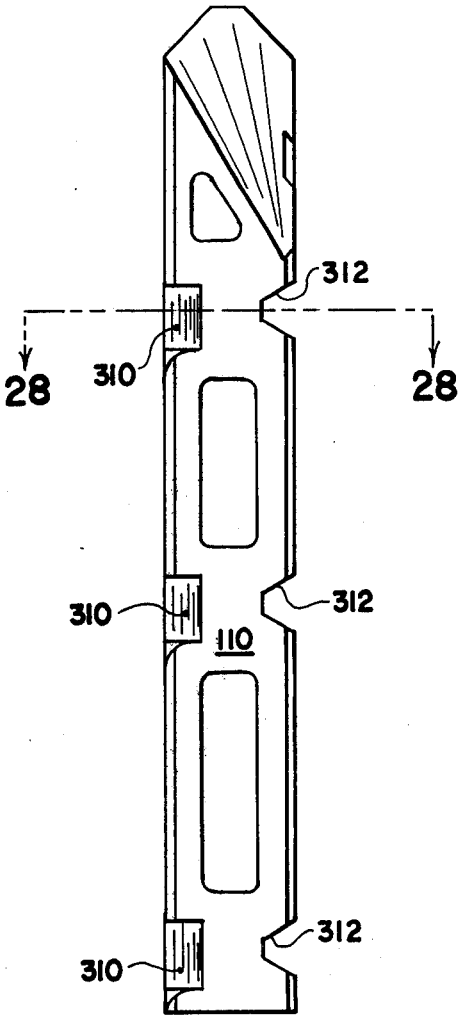
FIG. 24 is a front elevational view of a mandrel of the banding apparatus of FIG. 2.
Figure 25:
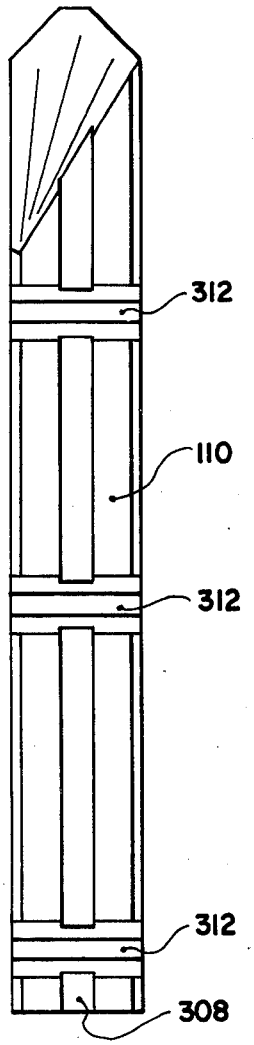
FIG. 25 is a side elevational view of the mandrel of FIG. 24.
Figure 28:
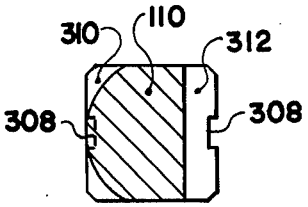
FIG. 28 is a transverse sectional view of a mandrel taken along lines 28—28 of FIG. 24.
Figure 27:
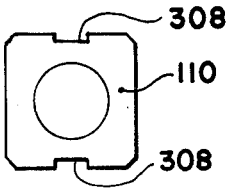
FIG. 27 is a bottom plan view of the mandrel of FIG. 25.

FIGS. 24, 25, 26, and 27 are front elevational, side elevational, top and bottom views of a mandrel 110 and FIG. 28 is a sectional view of a mandrel 110 taken along line 28-28 of FIG. 24. Mandrel 110 includes longitudinal grooves 308, convex radiused notches 310, and block V-notches 312.

Figure 29:
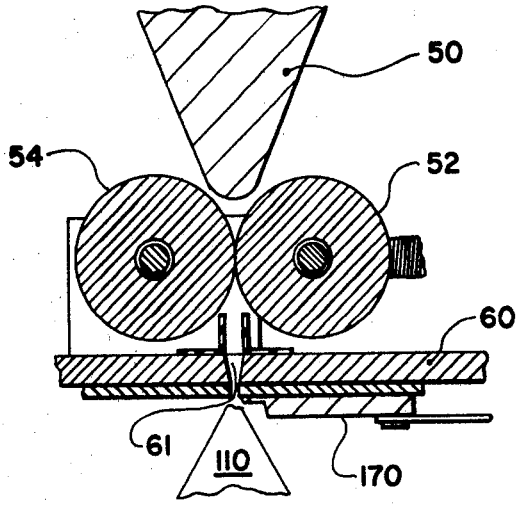
FIG. 29 is a transverse sectional view along line 29 of FIG. 3.

FIG. 29 is a transverse sectional view through separator 50 along line 29 of FIG. 3 further illustrating the shape of separator 50, attachment of shearing blade 170 to, and the feed through slot 61 in, upper support platform 60.

Figure 30:
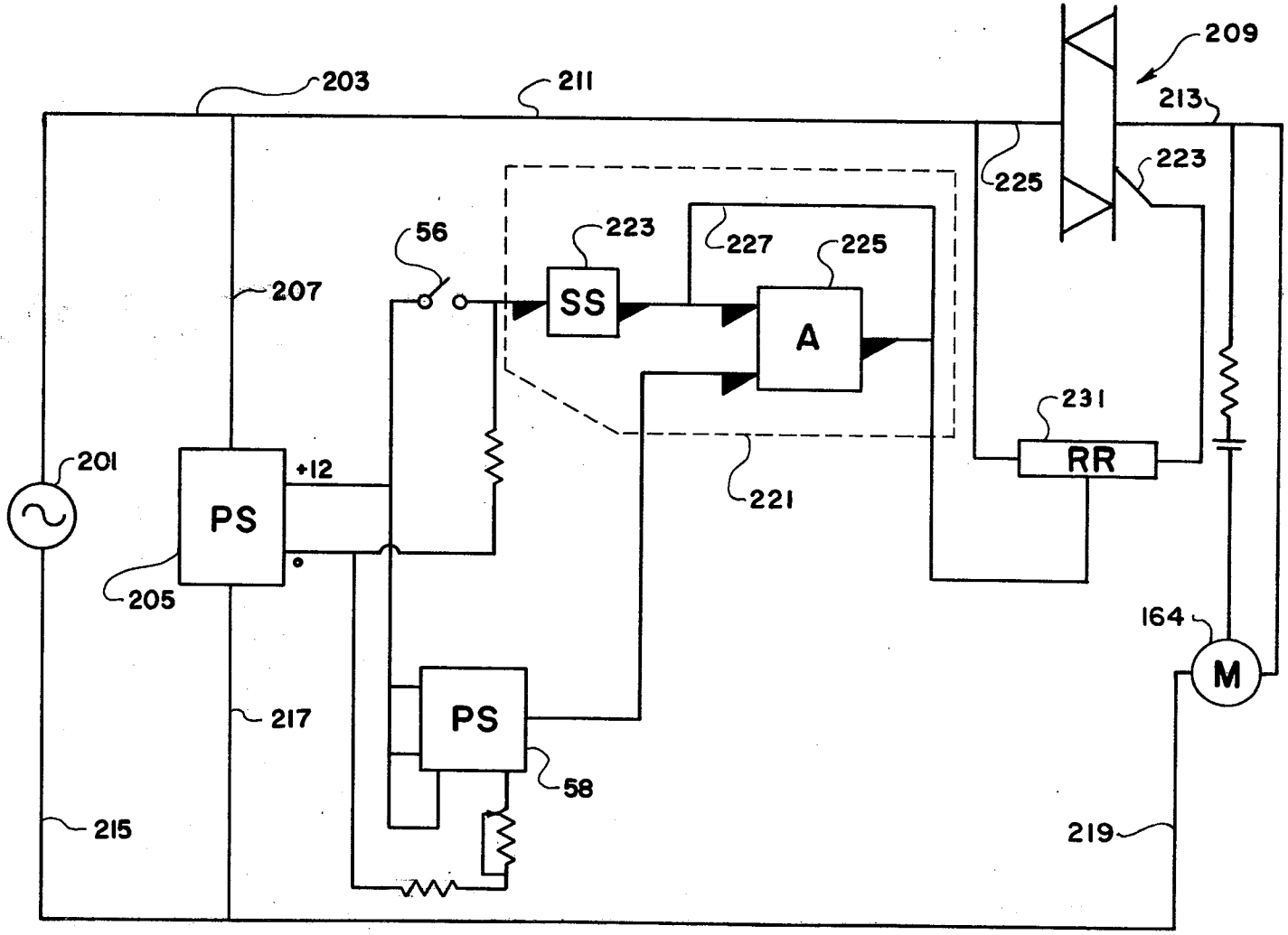
FIG. 30 is a schematic wiring diagram of the tube feed mechanism electrical components.

FIG. 30 is an electrical schematic wiring diagram of the tube feed mechanism 32 electrical components. In FIG. 30, logic circuits are described and illustrated by means of "top-hat" logic symbols and terminology. A source of conventional 60 cycle, 115 volt A-C power is shown as 201. The "hot" conductor 203 is applied directly to a logic level power supply 205 by conductor 207 and through a triac 209 to motor 164 via conductors 211 and 213. The A-C power "neutral" conductor 215 is directly applied to power supply 205 and motor 164 by leads 217 and 219. Operation of motor 164 is under control of gating logic 221, switch 56, and tube position photo sensor 58. Sensor 58 includes a light detecting diode which drives a darlington amplifier, neither of which are shown and each of which are standard, commercially available electrical components and circuits. Gating logic 221 includes a single shot 223 and an AND gate 225. The AND gate 225 has an input and its output interconnected by combination by-pass/feedback conductor 227. The AND gate 225 output is connected to the input of a reed relay 221 which is connected between the gate lead 223 and plate lead 225 of triac 209.

Figure 31:
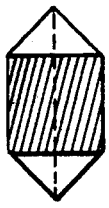
FIG. 31 is a transverse sectional view through the middle of the tube opener taken along line 31—31 of FIG. 2.
Figure 32:
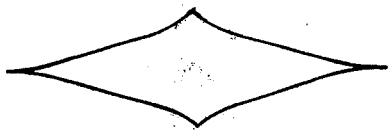
FIG. 32 is an end view of a typical tube as it is fed through the apparatus upper support platform just prior to being fed onto the receiving end of the mandrel; and, FIG. 33 is a fragmentary view of an alternative embodiment of a banding apparatus according to the present invention.

FIG. 31 is a sectional view through tube opener 50 taken along lines 31-31 of FIG. 2 and FIG. 32 is an end view of a typical tube 44 after it has been opened by tube opener 50 and had an additional pair of creases added to it by feed rollers 52 and 54.

Figure 33:
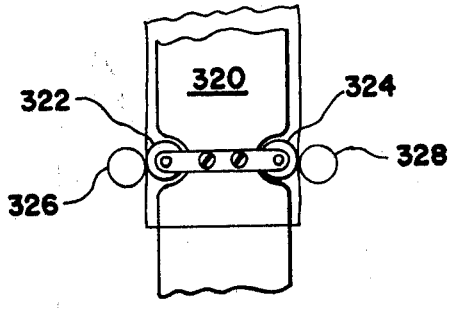

FIG. 33 is a fragmentary view of the principal components of an alternative embodiment of a positively controlled, straight line transport path banding apparatus according to the present invention. In FIG. 33, a mandrel 320 incorporates recessed friction-clutch idler wheels 322 and 324. Drive wheels 326 and 328 are mounted slightly below but otherwise in position to drive idler wheels 322 and 324. By operating drive wheels 326 and 328 to turn idler wheel 322 counterclockwise and idler wheel 324 clockwise, the friction-clutch property of the idler wheels translates part of the rotational force transmitted to the idler wheels by the drive wheels into a linear force which tends to force mandrel 320 downwards. By providing multiple sets of idler drive wheel combinations spaced apart vertically distances further than one-half a band length, and employing reversible direction motors for driving the drive wheels, a composite linear vertical force of zero, i.e. of just enough to hold the mandrel in place, can be provided.

The preferred embodiment illustrated in and described with reference to FIGS. 2 through 31 has been constructed by means of the components and materials in Table I below:

TABLE I

TUBE SUPPLY 30 tube 44: $1\frac{1}{2}$ millimeter thick by 95 millimeter wide polyvinylchloride film including $\frac{1}{8}$ inch wide $\times \frac{1}{4}$ inch long opaque marks at intervals of $5\frac{3}{4}$ inches, such as marketed by the Gilbreath Company, Philadelphia, Pennsylvania;

tube guide 46: 1/16×4½×6 inch sheets of plastic, such as ultra high molecular weight plastic spaced apart about 1/32 of an inch;

TUBE DRIVE MEANS 32 separator 50: double ended wedge with the wedge ends rotated ninety degrees; basically a square elongate block with overall dimensions of 3×3×4 inches shaped into the double ended wedge, each wedge being a diagonal of the square; the material was a plastic, specifically, plexiglass;

feed roller 52: 1¾ inch diameter by 3¾ inch long aluminum roller; relieved to a depth of about 0.030 inch for one half inch at each of the ends and in the center of the roller;

feed roller 54: 2 inch diameter by 4 inch long aluminum roller;

feed roller mounting means:

½×¾×5½ inch aluminum bar

½×1½×1 inch aluminum bar

⅜×1½×5 inch aluminum plate the foregoing together with a cold rolled steel trunion provide a mount for roller 52; the trunion includes ⅜ inch ball bearings in a bearing mount for each end of roller 52; a ⅜ inch diameter by 3¼ inch shaft extends from each bearing mounting and carries thereon a spring for urging roller 52 against roller 54; each shaft is mounted in the above ½×1½ inch bar and both shafts are retained (such as when a roller 52 is removed) by the above ½×¾ inch bar;

roller 54 is mounted by 2¼×⅜×1¾ inch aluminum blocks, each including a ⅜ inch ball bearing;

electrical components:

drive motor 164: 1/50 horsepower, 72 rmp, AC synchronous motor, such as the SS-50 Slosyn (TM) motor of Superior Electric Co., Bristol, Conn. (the SS-50 includes the series connected resistor and capacitor shown connected to the motor in FIG. 29);

power supply 205: DC power supply providing a plus 12 volts and a zero volt (common) output, such as Solid Controls, Inc. (SCI) of Minneapolis, Minn., their part number PR75-A1;

Triac 209: rated at one hundred thirty volts and 0.75 amps; a suitable triac together with a reed relay input stage is available from said SCI, its card number 080-2382;

switch 56: microswitch rated at 125 volts, 15 amps, such as manufactured by the Honeywell Corporation, Freeport, Ill., their part no. BZEG-2RQ;

photo sensor 58: twelve volt output light emitting diode, such as manufactured by HIE, Inc., Jonathan Industrial Center, Chaska, Minn., their part number OS-561-A-125WW (the HEI sensor includes an output amplifier, specifically, a darlington amplifier);

variable resistor 217: a zero to one hundred thousand ohm, one-half watt trimpot, available from said SCI, its card number 080-2400-11;

single shot 223: responsive to a plus twelve volt input to provide an RC time constant output which is initially plus twelve volts and falls off to the cut-off point required to activate AND 225 in about 15 milliseconds, available from said SCI, its card 080-2339-123;

AND gate 225: responsive to plus twelve volt "active" inputs to provide a plus twelve volt "active" output; available from said SCI, its card 080-2370; (if a tube 44 having transparent registration marks is used, as SCI card 080-2354 can be substituted, which, effectively, is the same thing as inverting the output of photo sensor 58);

reed relay 231: rated at 12 volts, 10 milliamperes; (see triac 209 above for a source);

load resistor 219: 270Ω, one watt;

MAIN FRAME 34 upper platform 60: ⅜×9×11 inch mild steel plate, Blanchard ground on both sides, and including a tube feed through slot about four inches long and tapering in width uniformly from ¼ inch on the top side of the plate to 1/16 inch on the bottom side;

banding platform 62: 3¾×4×6⅛ inch aluminum plate bottom plate 63: ⅛×2×4 inch cold rolled steel plate;

back rail 65: ⅜×½×4 inch cold rolled steel bar;

back plate 64: ½×4×25⅜ inch aluminum plate;

back plate to upper platform reinforcements 67: ⅜×3×3 inch aluminum plate;

support member 66: formed from an equilateral triangle of ¾ inch thick cold rolled steel each corner of which is truncated an equal amount; the sides of the triangle after truncation of the corners are 13½ inches long;

bearing 68: 8½ inch outside diameter by 7½ inch inside diameter by ½ inch thick conventional ball bearing available from Kaydon Bearing Company, a division of Keene Corporation, Muskegan, Mich., its part number 81-KO-75;

bearing seat 69: mild steel weldment with an L-shaped ledge for supporting the bearing of slightly less than the bearing width;

retainer ring 71: 6¾ I.D.×8¼ O.D.×3/16 inch thick cold rolled steel positioned to cover about ⅔ of the bearing;

BAND TRANSPORT MEANS 36 mandrel 110: 1¾×1¾×13¼ inch aluminum bar stock milled to shape as per FIGS. 24 through 28;

holding arms 112, 114, & 116: milled to shape out of aluminum stock; the radiused bite and gear tooth bite portion are separate pieces, are similarly milled to shape, and the holding arms and bite pieces fit together with a tongue and groove construction;

positioning springs: cadmium plated music wire believed to be about 0.059 inches in diameter, with 12 turns over ⅝ inch and a 180° offset, available as Lee Spring Company, 30 Main Street, Brooklyn, N.Y., part number LT-054-K6-LH;

vertical locating collars: 5/16 inch SHAFT COLLAR, available from the Ruland Manufacturing Company, Watertown, Mass., mandrel movement means 118:

support plate 124: ⅜×4×11 inch aluminum plate;

collars 126 and 128: ¾×1×1⅛ inch aluminum bar stock with a ⅜ inch I.D. by ⅝ inch O.D. by about ⅞ inch long linear bearing press fit into a ⅝ inch diameter bore in the cam block, the bearing is available as a Heim Company, Fairfield, Conn., part.

guide rod 130: ⅜ inch diameter× 15¼ inch length of shafting such as is available from said Heim Company;

mounting blocks 230 and 232: ¾×1×1⅛ inch aluminum bar stock with a ⅜ inch diameter guide rod mounting hole and 3/16 inch back plate mounting hole.

lever/32: $\frac{1}{2}\times4\frac{1}{4}\times5$ inch cold rolled steel plate cut to size and shape with a one inch diameter by one inch spacer welded to each side; each spacer includes an aperture with an oilite bearing for acceptance of pin 220; a $\frac{3}{8}$ I.D.$\times\frac{7}{8}$ O.D.$\times$ about 0.281 thick ball bearing is included on the lever at the point of contact with timer mandrel positioning actuator 22.

plates 212 & 214: $\frac{3}{8}\times2\times3$ inch aluminum plate with a $\frac{3}{8}$ inch diameter pivot pin mounting hole;

pin 210: $\frac{3}{8}\times4$ inch cold rolled steel pin with a 0.027 inch$\times$0.027 inch circumferential pin retainer groove on each end;

pin retainer: $\frac{3}{8}$ inch C-ring;

supports 222 & 224: $\frac{3}{8}\times1\times2$ inch aluminum plate with a $\frac{3}{8}$ inch diameter pin mounting hole;

pin 220: $\frac{3}{8}\times1\frac{1}{2}$ inch cold rolled steel pin with a 0.027 inch$\times$0.027 inch circumferential pin retainer groove on each end;

pin retainer: $\frac{3}{8}$ inch C-ring;

bolts 246: 3/16 inch diameter cap screws;

band stripper assembly 120:

finger 138: 16 gauge sheet metal cut and formed as shown in FIGS. 11, 12, and 13;

shaft 266: powdered metal bearing having a 3/16 inch diameter$\times1\frac{1}{8}$ inch long shaft in a $\frac{3}{8}$ inch O.D. sleeve available as an Oilite (TM), part number AA-307-7 bearing of Amplex Company, a division of Chrysler Corporation, Detroit, Mi.;

wheel 270: conventional 3/16 inch I.D. by $\frac{1}{2}$ inch O.D. ball bearing;

wheel lever 264: $\frac{3}{8}\times\frac{3}{8}\times2$ 1/6 inch cold rolled steel bar stock machined to shape;

spring 286: unknown and not considered critical in any way;

cam block 140: $1\frac{7}{8}\times2\frac{1}{2}\times6$ inch aluminum bar stock machined to shape as shown in FIGS. 14, 15, 16, & 17 cam shoe 276: $1\frac{1}{4}$ inch length of $\frac{1}{2}\times\frac{3}{4}$ inch cold rolled steel bar stock sheared to conform to cam block corner, and inserted into cam;

bore 282: $\frac{5}{8}$ inch diameter bore into which is inserted on each end an aforegoing described linear bearing;

tapped hole 284: 5/16 inch diameter;

shuttle rods 254: $\frac{3}{8}$ inch diameter by $20\frac{5}{8}$ inch length of shafting such as is obtainable from said Heim Company;

fasteners 256: 3/16 inch diameter cap screws;

band stripper assembly movement means 122:

cylinder 146: 5/16 inch diameter inputs including a needle valve adjustment, one inch diameter cylinder with a fifteen inch stroke, available as a Bimba Company, Monee, Illinois, model number 0915-OP;

a spacer block of $1\times1\frac{1}{4}\times2$ inch aluminum is inserted between cylinder 146 and support platform 60 to provide more convenient access to the cylinder pneumatic fittings, including the flow control valve;

switch 148: includes a spool type valve, pneumatic switch, available as a Clippard Instrument Laboratories, Inc., Cincinatti, Ohio, part number MJV-4;

TIMING MECHANISM 16 drum 80: $\frac{3}{8}$ inch thick wall thickness by six inch O.D. by $20\frac{7}{8}$ inches long mechanical steel tubing;

timer cutter actuator 18: heat treated, cold rolled steel plate machined to size and shape;

timer band stripper actuator 20: heat treated, cold rolled steel, machined to size and shape;

timer mandrel positioning actuator 22: heat treated, cold rolled steel, machined to size and shape;

timer tube feed actuator 24: heat treated cold rolled steel, machined to size and shape;

cap 81: aluminum slug turned to size and shape;

upper support member 70: an equilateral triangular shaped, $\frac{3}{4}$ inch thick, cold rolled steel plate, originally $16\frac{1}{8}$ inches on a side but having each corner truncated by about $4\frac{1}{8}$ inches resulting in sides actually about $7\frac{7}{8}$ inches long;

upper support member 72: $8\frac{3}{4}$ inch O.D. by $1\frac{1}{4}$ inch I.D. by $\frac{7}{8}$ inch thick cold rolled steel;

bearing 74: $3\frac{1}{4}$ inch O.D.$\times1\frac{1}{2}$ inch I.D. $\times2\frac{1}{4}$ inch thick double roller bearing with a grease fitting, available as Timken Company, Canton, Ohio parts 25572 and 255200;

oil seal 75: $1\frac{1}{2}$ inch I.D.$\times3.0$ inch O.D.$\times\frac{3}{8}$ inch thick rawhide seal, the properties of which are uncritical and the exact source of the seal actually used is therefore not considered critical; such seals are obtainable from the mechanical rubber division of Garlock, Inc., Palmyra, New York;

output shaft 86: $\frac{1}{2}$ inch I.D.$\times1\frac{3}{4}$ inch O.D. by 42 inch long mechanical tubing: available from the Ryerson Steel Company, Minneapolis, Minnesota;

pneumatic fitting 77: 2 inch diameter by $1\frac{5}{8}$ inch long aluminum slug machined and bored as per FIGS. 2 & 3;

TUBE CUTTING MEANS 38:

shearing blade 170: sheet tool steel, $2\frac{3}{4}\times6\frac{1}{4}\times\frac{1}{4}$ inch thick, cut to shape, surface ground, and one edge sharpened; original blank of $2\frac{3}{4}\times6\frac{1}{4}$ dimensions;

stationary shear plate: $\frac{1}{8}\times1\times6\frac{1}{2}$ inch tool steel surface ground for flatness and uniform thickness; one edge sharpened; attached to the underside of plate 60 across the feed through slot from shearing blade 170;

spacer plate: $\frac{1}{8}\times2\times6\frac{1}{2}$ inch tool steel, surface ground for flatness and uniform thickness; attached to the underside of plate 60 between shearing blade 170 and plate 60;

link 174: $\frac{1}{8}\times\frac{1}{2}\times7$ inch cold rolled steel;

follower 176: $\frac{1}{2}\times1\frac{1}{2}\times3$ inch cold rolled steel machined to size and shape;

wheel 178: $\frac{5}{8}$ O.D. by $\frac{1}{4}$ I.D. by 0.189 inch thick conventional ball bearing, available from virtually every conventional ball bearing manufacturer;

USE OF THE INVENTION

Description of use of a banding apparatus 14 according to the present invention shall be with reference to the angular position, referred to as a "timing position" of an apparatus 14 relative to drum 16. For a multi-apparatus banding station such as illustrated in FIG. 1, the apparatus 14 rotates about a stationary timing mechanism 16. The following description of use is directed to the banding apparatus per se and is exclusive of auxiallary cooperative mechanisms such as the film shrinking means and means for placing and removing an article to be banded on banding platform 62. As points of reference for the following description of use, an article is placed on the banding platform at a timing position of one hundred degrees, (100°) and removed at a position of about three hundred sixty degrees (360°). For purposes of this description, a banding cycle is assumed to start at a zero degree (0°) timing position. For a zero degree timing position,

758A timer band stripper actuator 20 is disengaged from

758B switch 148 and switch 148 passes air from bore 88 to the

758C lower end of cylinder 146 to force output shaft 260 of

758D hydraulic cylinder 146 to a fully withdrawn position and

758E hold band stripper assembly 120 in its raised position.

758F In this raised position, cam wheels 270 are driven outwards

758G by tapered surface 250 of stationary cam 248 to position cam

758H fingers 138 in a fully open position and provide clearance

758I between cam finger 138 and mandrel 110 for free and clear

758J passage of the end of tube 44 as it is fed onto mandrel 110.

758K Mandrel 110 is likewise in its raised position in the zero

758L degree timing position as a result of raised position portion

758M 196 of timer mandrel positioning. actuator 24 acting against lever 32. Preliminary to commencing operation, the end of tube 44 is threaded through tube guide 46, tube separator 50 is inserted in the tube 44, the end of tube 44 is passed between drive rollers 52 and 54 and through the feed slot in upper support 60, and a registration mark is positioned with its rearward edge just under photo sensor 58. Tube separator 50 promotes a ninety degree rotation of tube 44 between tube guide 46 and drive rollers 52 and 54 which as, previously stated, are themselves rotated ninety degrees. Such rotation results in a second pair of opposing creases as tube 44 is pressed flat by drive rollers 52 and 54. Upon clockwise revolution (as viewed from above) of drive shaft 86 past the zero degree timing position, switch 56 of drive motor 164 is actuated by timer tube feed actuator 24 to commence feed of tube 44 onto mandrel 110. With switch 56 actuated, single shot 223 is triggered and outputs a pulse which by virtue of the by-pass property of conductor 227 is applied directly to the reed relay 211 which controls the gate lead 213 of triac 209. Triac 209 conducts to start motor 164. For the particular preferred embodiment, tube 44 which itself is transparent, is provided with opaque registration marks along one edge at intervals equal to the band length ($5\frac{3}{4}$ inches). As motor 164 drives feed roller 152, the tube edge with the opaque registration marks is fed past tube position sensor 58. For the particular preferred embodiment of $\frac{1}{4}$ inch long registration marks and tube feed speed of 0.875 inches per second, before the 15 millisecond fall time of single shot 223 output pulse occurs, the registration mark passes from underneath tube position sensor 58 which thereupon reverses its output state to apply an activating signal to AND gate 225. With single shot 223 still providing an output, all inputs to AND gate 225 are active. The gate 225 output thus also is active even after the pulse from single shot 223 ends because all inputs of AND gate 225 remain active by the continued presence of the activating signal from sensor 58 and the feedback property of conductor 227 which applies the AND gate 225 output signal as an activating signal to the other gate 225 inputs which previously had been active from the single shot 223 signal. The AND gate 225 remains active so long as the input from tube position sensor 58 remains active, namely, until another registration mark passes under the sensor at which time the input from tube position sensor 58 to AND gate 225 switches to an inactive state. With the input inactive, the AND gate 225 output similarly goes inactive and the triac 209 in turn stops conducting to turn-off motor 164. At a timing position of one-hundred (100) degrees, wheel 178 of follower 176 of cutting means 38 is forced outwards as it transverses channel 180 of timer cutter actuator 18. The outward travel of wheel 178 is transmitted and translated through follower 176 and link 174 to shearing blade 170 which pivots around pivot pin 172 and shears tube 44 against the edge of the shearing plate attached to upper support platform 60 to provide a band the lowermost end of which has already been fed onto the receiving end of mandrel 110. Upon completion of cutting of the tubing, at a timing position of about one-hundred fifteen (115) degrees, wheel 178 clears channel 180 to return shearing blade 170 to its original position, and timer mandrel positioning actuator 22 releases lever 332 of mandrel movement means 118 to lower mandrel 110 to its lowered position. At a timing position of about 120 (one hundred twenty) degrees, timer band stripper actuator 20 operates switch 148 to a position which reverses the air (from a source of compressed air coupled to the bore 88 of drive shaft 86) from the lower to the upper end of cylinder 146 to drive output shaft 260 and band stripper assembly 120 downward. As band stripper assembly 120 commences its downward shuttle, cam wheels 270 are drawn inwardly towards each other by spring 286 as the wheels 270 follow the tapered surface 250 of stationary cam 248. At the point wheels 270 clear stationary cam 248, fingers 138 are in a fully closed position with each tooth 272 above the top edge of the band just cut from tube 44. As the band stripper assembly is driven downward, each finger tooth 272 is engaged in a groove 308 of mandrel 110 and the cam block 140 downward shuttle tapered surfaces 280 engage the holding arm downward shuttle wheels 300 to swing open the holding arms in advance of and during passage of a band. At any given time, at least two pairs of holding arms are fully closed on mandrel 110. In the downwardmost position of band stripper assembly 120, fingers 272 clear the bottom of mandrel 110 to completely strip a band from the mandrel. A source of compressed air operating on cylinder 146 of about 45 to 50 (forty-five to fifty) pounds per square inch, and a drive shaft rotation of $16\frac{2}{3}$ revolutions per minute, are employed and cylinder 146 includes a needle valve air input adjustment which is set to cause the downwardmost position to be reached in about ninety-seven (97) degrees of revolution, i.e. at about a timing position of (217) two hundred seventeen degrees. The downwardmost position is held for about three degrees. At timing position 220 (two hundred twenty) degrees, timer band stripper actuator 20 permits switch 148 to again reverse states and switch air from the top to the bottom of cylinder 146. With the air applied to the bottom of cylinder 146 output shaft 260 withdraws into cylinder 146 causing the piston on shaft 260 to vent the air in cylinder 146 to atmosphere through switch 148. As shaft 260 withdraws into cylinder 146, upward shuttle tapered surfaces 278 of cam block 140 act against the upward shuttle wheels 302 of the holding arms to open the holding arms in sequence and permit return of band stripper assembly 120 to its raised position. A timing position three hundred forty degrees, timer mandrel positioning actuator 22 forces lever 132 inward to raise mandrel 110 to its raised position ready to receive the end of tube 44 after commencement of the following banding cycle as the timing mechanism 16 again passes through the zero degree timing position.

The foregoing described and illustrated preferred embodiment is particularly amenable to a multi apparatus revolvingg banding station such as illustrated in FIG. 1. Such a banding station should be as light as possible. The apparatus of the present invention is free of such weight adding components as multiple mandrels and means for rotating or nonaxially circuitously shuttling the mandrel back and forth between band loading and band discharging stations. In addition, the present invention operates at high speeds with a high degree of accuracy. Band transport is by a combination of mandrel movement and stripping of the band along the length of the mandrel. Band transport is in a straight line from the band source to placement on the article being banded. Only a single mandrel is required. Mandrel and band movement is axial, straight line. A band is positively controlled at all times. Positive control and the various inflections and conjugations thereof used herein means control by actual physical contact, and is exclusive of control such as by negative or positive air pressures.

The foregoing description of a preferred embodiment of the invention is given by way of illustration and not limitation and various modifications and variations thereof fall within the scope of the present invention. For example, it is specifically contemplated that in future designs, the square shaped cross-section mandrel shall be replaced with a mandrel of circular cross-section. And, again by way of illustration and not limitation, another straight line positively controlled band transport apparatus is schematically illustrated in FIG. 3. In this embodiment, combinations of driver and idler wheels are employed to both hold the mandrel and to transport a band along the mandrel. In the illustrative embodiment, one set of opposing pairs of idler and drive wheels are shown although it is contemplated that at least three pairs of idler drive wheels would be employed. Idler wheels 322 and 324 resist turning sufficiently that by turning an upper set of idler wheels in one direction and turning a lower set of idler wheels in another direction, offsetting linear forces are produced which hold mandrel 320 in position. By providing at least three idler-drive wheel pairs along the mandrel at intervals of slightly more than one-half a band length, two pairs can always be driving in opposite directions to hold the mandrel while the other pair is transporting the band. These and other modifications of the invention obvious to one of the ordinary skill in the art are deemed within the scope of the present invention.

What is claimed is:

1. In a banding apparatus applying a band to an article to be banded, having means for feeding a tube, means for opening such tube, means for cutting such band from such tube, means for rapidly presenting each of a plurality of such articles sequentially to a banding platform, and timing means for controlling the sequence of operation of the various means of the banding apparatus, the improvement comprising:

(A) an elongated mandrel aligned along a straight line path between said cutting means and the article at said banding platform, said mandrel including a receiving end receiving the tube and a delivery end off of which a band is stripped, said mandrel having at least one groove extending between said receiving and said delivery ends;

(B) band urging means for urging the band cut from the tube onto and along the length of said mandrel and for stripping the band from said mandrel delivery end onto the article to be banded, said means for urging the band including at least one finger disposed out of contact with the tube as the tube is fed onto said mandrel receiving end but responsive to cutting the band to move inwardly toward said mandrel groove and downwardly along said groove to engage the upper end of the band and urge the band along and off said mandrel and onto the article to be banded, said means also including arms secured to a movable cam block which is mounted for shuttle-like travel parallel and adjacent to said mandrel; and (C) holding means for operably holding said mandrel in synchronism with said band urging means to permit passage of the band past said holding means, said cam block including a lower end which operates in advance of the band to sequentially disengage said holding means from said mandrel as said cam block moves downwardly toward said delivery end, said cam block holding said arms in disengagement from said mandrel until the band has traversed past said arms, whereby when an open end of the tube is fed onto the receiving end of said mandrel and the tube is cut to provide a band, movement of the band from the time and position of cutting until the band is at least partially positioned on an article is controlled and guided by the mandrel, and control and guidance of the band, if any, during any remaining position of the band over the article is by the article itself.

2. In a banding apparatus applying a band to an article to be banded, having means for feeding a tube, means for opening such tube, means for cutting such band from such tube, means for rapidly presenting each of a plurality of such articles sequentially to a banding platform, and timing means for controlling the sequence of operation of the various means of the banding apparatus, the improvement comprising:

(A) an elongated mandrel aligned along a straight line path between said cutting means and the article at said banding platform, said mandrel including a receiving end receiving the tube and a delivery end off of which a band is stripped, (B) band urging means for urging the band cut from the tube onto and along the length of said mandrel and for stripping the band from said mandrel delivery end onto the article to be banded, said band urging means including an alongated cam block carrying thereon means for positively engaging the band on said mandrel, said cam block having a lower end adapted for pivoting said holding arms to a position of disengagement from the mandrel during downward travel of said cam block and having an upper end adapted for pivoting said holding arms to a position of disengagement during upward travel of said cam block, said cam block being mounted for travel from a position above, to a position below, said mandrel; and (C) holding means for operably holding said mandrel in synchronism with said band urging means to permit passage of the band past said means, said holding means including a pluarlity of pivotally mounted holding arms mounted for pivtal movement between positions of engagement and disengagement of said mandrel, said holding means being mounted for reciprocal movement along a path parallel to the straight line path between said cutting means and said banding platform to provide reciprocal movement of said mandrel held by said holding means, whereby when an open end of the tube is fed onto the receiving end of said mandrel and the tube is cut to provide a band, movement of the band from the time and position of cutting until the band is at least partially positioned on an article is controlled and guided by the mandrel, and control and guidance of the band, if any, during any remaining position of the band over the article is by the article itself.

3. In a banding apparatus according to claim 2, wherein said holding means includes a plurality of vertically oriented traverse rods having a generally rectangular back plate mounted for vertical movement upon said traverse rods, said back plate including a pair of holding arms pivotally attached to and positioned near the top of said back plate, a pair of holding arms pivotally attached to and intermediate said back plate, and a pair of holding arms pivotally attached to and near the bottom of said back plate.

4. In a banding apparatus applying a band to an article to be banded, having means for feeding a tube, means for opening such tube, means for cutting such band from such tube, means for rapidly presenting each of a plurality of such articles sequentially to a banding platform, and timing means for controlling the sequence of operation of the various means of the banding apparatus, the improvement comprising:

(A) an elongated mandrel aligned along a straight line path between said cutting means and the article at said holding platform, said mandrel including a receiving end receiving the tube and a delivery off of which a band is stripped, (B) band urging means for urging the band cut from the tube onto and along the length of said mandrel and for stripping the band from said mandrel delivery end onto the article to be banded, said band urging means including a cam block carrying thereon means for positively engaging the band on said mandrel, said cam block having a lower end adapted for pivoting said holding arms to a position of disengagement from the mandrel during downward travel of said cam block and having an upper end adapted for pivoting said holding arms to a position of disengagement during upward travel of said cam block, said cam block being mounted for travel from a position above, to a position below, said mandrel; and (C) holding means for operably holding said mandrel in synchronism with said band urging means to permit passage of the band past said means, said holding means including a plurality of pivotally mounted holding arms mounted for pivotal movement between positions of engagement and disengagement of said mandrel, whereby when an open end of the tube is fed onto the receivng end of said mandrel and the tube is cut to provide a band, movement of the band from the time and position of cutting until the band is at least partially positioned on an article is controlled and guided by the mandrel, and control and guidance of the band, if any, during any remaining position of the band over the article is by the article itself.

5. In a banding apparatus according to claim 4, the improvement wherein said mandrel holding means is mounted for reciprocal movement along a path parallel to the straight line path between said means for cutting and said banding platform to provide reciprocal movement of said mandrel held by said holding means.

6. In a banding apparatus according to claim 5, the improvement wherein said timing means includes a driven circular drum carrying thereon a tube feed actuator, a cutter actuator, a mandrel positioning actuator, and a band stripping actuator.

* * * * *